United States Patent [19]

Garner

[11] 4,265,686

[45] May 5, 1981

[54] POWER FILLING OF CABLE CORE UNITS

[75] Inventor: John N. Garner, Pointe Claire, Canada

[73] Assignee: Northern Telecom Limited, Montreal, Canada

[21] Appl. No.: 74,970

[22] Filed: Sep. 13, 1979

[51] Int. Cl.[3] ..... H01B 13/06

[52] U.S. Cl. ..... 156/48; 118/634; 118/DIG. 5; 174/102 P; 427/117; 427/118; 427/120; 427/185

[58] Field of Search ..... 174/102 P, 118; 118/DIG. 5, 634; 156/47, 48; 427/117, 118, 120, 185

[56] References Cited

U.S. PATENT DOCUMENTS

| | | | |
|---|---|---|---|
| 3,889,455 | 6/1975 | Portinari et al. | 156/48 |
| 3,918,281 | 11/1975 | Priaroggia | 156/48 |
| 3,951,712 | 4/1976 | Nakata | 156/48 |
| 4,084,019 | 4/1978 | Christ et al. | 118/DIG. 5 |
| 4,098,927 | 7/1978 | Gray et al. | 427/185 |
| 4,100,002 | 7/1978 | Woytiuk et al. | 156/48 |
| 4,122,212 | 10/1978 | Walling | 427/185 |
| 4,205,515 | 6/1980 | Garner | 156/48 |
| 4,224,090 | 9/1980 | Garner | 156/48 |

OTHER PUBLICATIONS

"Fluidized Bed Coating" J. Gaynor, *Chemical Engineering Progress* vol. 56, No. 7, pp. 75–78 1960.

"Fluidized Bed Method Coating," L. Stott, *Organic Finishing* Jun. 1956, pp. 16–17.

*Primary Examiner*—Stanley S. Silverman

*Attorney, Agent, or Firm*—R. J. Austin

[57] ABSTRACT

Cable core units comprising conductors grouped together by twisting are fed through a fluidized bed to fill voids with fluidized powder by flow of the powder between the grouped conductors. While still in the bed, the units are then deflected around rollers to cause relative displacement of the conductors which causes more complete filling of the voids with powder and powder redistribution to create uniformity of powder fill. Cable cores may also be filled with the core units closed together or separated in the bed but with units closed together when a core is deflected around the rollers.

8 Claims, 8 Drawing Figures

POWER FILLING OF CABLE CORE UNITS

This invention relates to the powder filling of cable core units.

Cable cores are made either as a single core unit or as a plurality of core units, each unit comprising conductors grouped together by twisting.

The voids between conductors of a cable core are filled with a material, for example grease. The use of grease is inconvenient both in cable manufacture and use. Problems are created when conductor ends of cable have to be joined as the grease has to be removed to ensure clean joints. This is a messy and unpleasant operation.

As an alternative procedure, it has been proposed to fill the voids between conductors with a powder. In one powder filling method, the individual conductors of a core unit, in spaced-apart relationship, are oiled and are then passed through a powder applicator. To make the core unit, the conductors are then closed together and trap powder between them inside the voids. The filling is sometimes variable and the use of oil still creates problems when joining conductor ends. Problems are also caused in obtaining continuous running of the powder filling apparatus as excessive amounts of oil and powder can jam cable unit closing dies.

In U.S. application Ser. No. 921,252 filed July 3, 1978 now abandoned, in the name of the present assignee, there is described a method of powder filling a multi-conductor cable core comprising passing the cable core through a fluidized bed of filling powder, the cable conductors being in a substantially closed condition before entering the fluidized bed.

According to the present invention there is provided a method of powder filling a cable core unit wherein the cable core unit is passed along a pass line through a fluidized bed of filling powder, and with the conductors closed together, the direction of movement of the core unit along the pass line is changed at least once to effect relative displacement of the conductors.

In the last preceding paragraph and elsewhere in this diclosure and claims, the term "fluidized bed" refers solely to a bed of powder which is fluidized and has a definite upper surface. Under certain operating conditions, dust or a cloud of powder particles may appear above the fluidized bed. Such dust or cloud is above the definite upper surface and is not considered as part of the bed.

It is found that while passage of the cable core unit through the fluidized bed with the conductors closed together results in an efficiently powder filled unit, the voids are more completely filled with an overall uniformity of filling, if the unit is caused to change in its direction of movement as specified by this invention. The reason for this is believed to be because the relative movement of the conductors momentarily changes the shapes and sizes of any small gaps between adjacent conductors such as to assist flow of the fluidized powder through the gaps and into the voids between the conductors. Further conductor movement causes redistribution of powder already in the voids so that it tends to fill less densely filled regions and gives greater uniformity of filling.

In practice, the unit is passed partly around the periphery of a rotatable member each time its direction of movement is changed.

The invention also applies to the powder filling of a cable core composed of a plurality of core units. Each of the core units is powder filled by keeping the conductors closed together. However, the core units themselves may be spaced-apart or closed together dependent upon the construction of cable core. For instance, where the cable core is composed of core units all of which lie at the outside of the core, then it should be possible to powder fill all of the core units and voids between units by passing the core through the bed with the units closed together. The whole cable core is then subjected to a change in direction across its pass line. Where, however, in a cable core construction at least one central core unit is used which is completely hidden from outside the cable core by outer units, then filling of voids of the central unit may be possible only by having the core units spaced-apart to enable the fluidized powder to pass between closed conductors of the central unit. It is unimportant whether the core units are completely closed together when they pass around the rotatable member, but they should be sufficiently closed together that the rotatable member effects relative displacement of the conductors of each core unit.

According to the invention also, apparatus for powder filling a cable core unit is provided in which at least one rotatable member is rotatably mounted within a housing for a fluidizable bed, the rotatable member being in a position above a porous member for supporting the bed and being located to engage a cable core unit as it is passed through the housing to cause a change in direction of movement along the pass line.

Embodiments of the invention will now be described, by way of example, with reference to the accompanying drawings in which:

FIG. 1 is a side view of apparatus according to a first embodiment;

FIG. 2 on a larger scale than FIG. 1 is a side view in cross-section of the apparatus of the first embodiment with electric cable passing through it;

Figure 4:
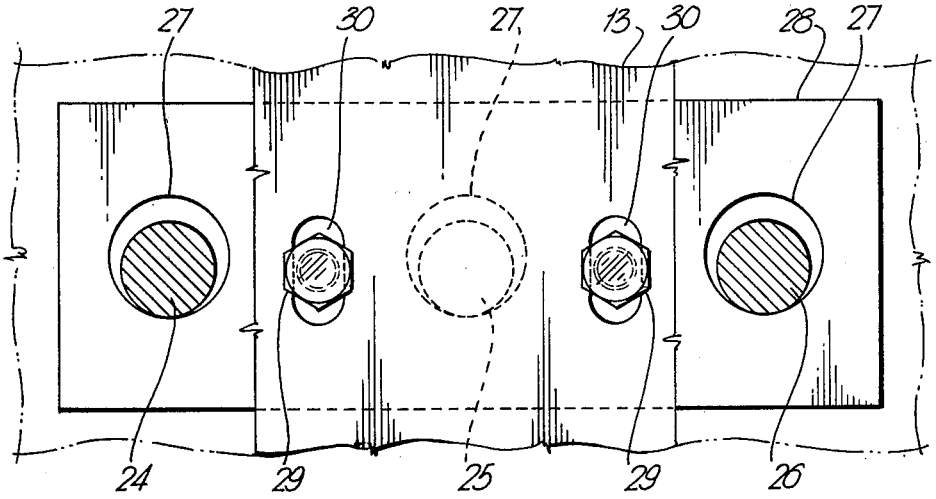
FIG. 4 is a cross-sectional view along line IV—IV in FIG. 3.
Figure 3:
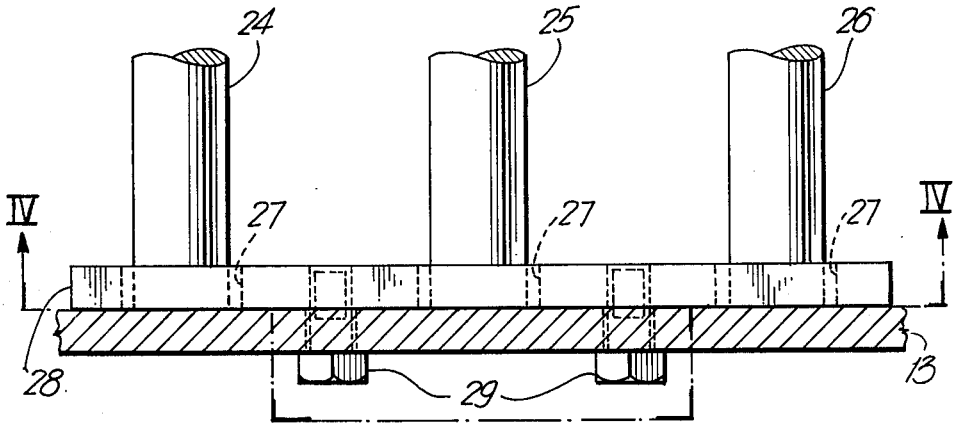
FIG. 3 is a cross-sectional view through part of the apparatus along line III—III in FIG. 2 and on a larger scale.
Figure 1:
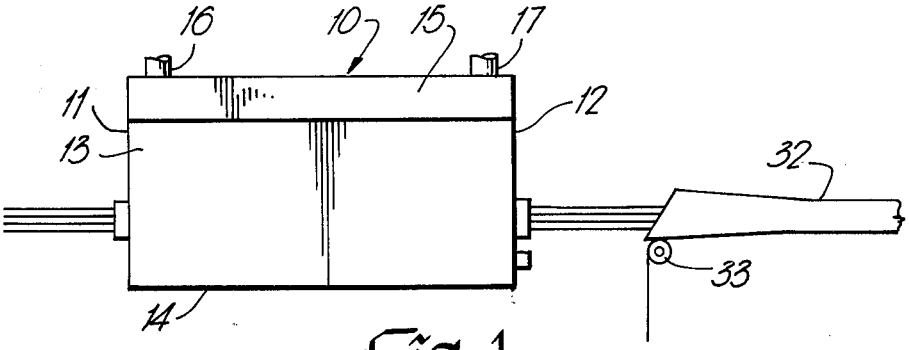

In the first embodiment as shown in FIG. 1, apparatus for powder filling of a multi-core unit cable comprises a housing 10 for a fluidizable bed of cable filling powder.

The housing comprises an inlet end 11, outlet end 12, sides 13 and bottom 14. A cover 15 on the housing has an inlet 16 for a supply of powder and an outlet 17 for removal of dust.

Figure 2:
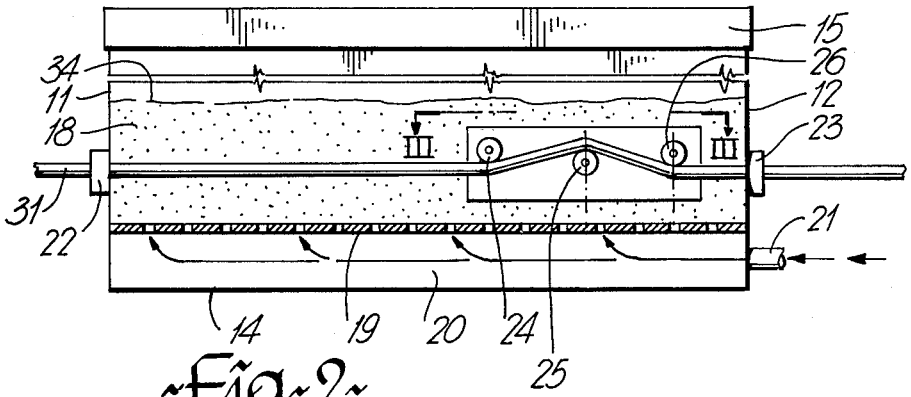

As shown more particularly in FIG. 2, the housing encloses a fluidizable bed of cable filling powder 18 above a porous member 19 extending right across the housing and defining an air chamber 20 beneath it. Air is supplied to the chamber through air feeding means in the form of an air inlet 21 extending through the outlet end 12 of the housing and communicating with air chamber 20. A cable inlet die 22 and outlet die 23 are mounted upon the inlet and outlet ends 11 and 12 in positions above the porous member 19 and below the upper surface of the unfluidized powder 18. The dies 22 and 23 are of such a diameter as to allow for the passage of a multiconductor cable with the conductors closed together.

The apparatus is provided with three rotatable members in the form of rollers 24, 25 and 26. These rollers are mounted above the porous member 19 and are immersed within the fluidized powder. The rollers are spaced apart between the inlet and outlet ends of the housing and lie roughly in line between the inlet and outlet dies. The rollers are rotatably mounted at their ends within oversize holes 27 defined in bearing members or plates 28 which are held by securing means in the forms of screws 29 in the sides 13 of the housing.

The screws 29 form part of a positioning means for the rollers to enable the rollers to be adjusted in position together with the fluidizable powder. The positioning means is also provided by the sides 13 which are formed with vertical slots 30 for passage therethrough of the screws which are screw threaded into the plates 28. As may be seen, loosening of the screws enables them to move up or down within the slots during vertical adjustment of the plates 28.

In the use of the apparatus, a cable core 31 is to be powder filled. This core comprises a plurality of cable core units each of which lies at the outside of the core. The core with conductors of the units and the units themselves closed together, is fed through the inlet die into the housing to pass it through the fluidized bed and out through the exit die 23 after which it is covered in tape 32 in conventional manner as shown in FIG. 1, the tape being fed beneath and alongside the cable core around roller 33 before being wound around the core. No part of the core has been oiled or greased before the core enters the bed as such a coating procedure hinders movement of filling powder between the conductors and into the voids within the core. In fact, the conductors of the core are devoid of any surface covering which would prevent passage of the powder into the voids. Likewise the core is not electrostatically charged before entering the bed for the same reasons, and the use of electrostatic filling methods forms no part of this invention. Hence, the core as passed into the bed in this embodiment is devoid of any means for attracting powder to the core surfaces as this would inhibit the flow of powder into the voids.

The powder 18 is fluidized by air under pressure passing through the air inlet 21 and through the porous plate into the powder to cause it to fluidize so that it has the flow or fluid characteristics of a conventional fluid while the upper surface 34 of the powder is a definite surface.

The rollers 24, 25 and 26 obstruct a straight line path through the bed for the core from inlet to outlet die, the core being pulled through the core with a pulling or wind-up mechanism (not shown). Hence, the core is necessarily passed around part of the periphery of each roller to enable it to reach the outlet die. Thus the core is caused to change its direction of movement along its pass line, first laterally in an upward direction around roller 24, then laterally in the downward direction around roller 25 and finally in the upward direction around roller 26 to become aligned with outlet die 23. The disposition of the core in this way causes the rollers 24 and 26 to move to the tops of their holes 27 and the roller 25 to the bottom of its hole 27 in plates 28, i.e. to place the rollers in staggered relationship as shown in FIG. 2.

The flexing of the core around each roller causes changes in tension in the individual conductors of each core unit as some conductors suddenly have longer paths of travel than others whereby relative movement between the conductors takes place at the positions of deflection. The passage of the core through the fluidized bed causes the fluidized powder to infiltrate between conductors to fill the voids and relative movement between the conductors results in a more complete and uniform filling operation. It is suggested that movement between conductors changes shapes and sizes of the defined gaps and this eases the paths between them for the powder.

The movement of the core around the rollers in the above embodiment is such that the core and thus each core unit is flexed first in one lateral direction and then another. This ensures that tensions are applied to the conductors from roller to roller in different ways so that the resultant conductor movements differ and further assists in the filling of the voids with powder.

The diameters and positions of the rollers depend upon the size of cable core and upon its unitary construction if optimum filling is to be obtained. In the first embodiment and others to be described, each roller is of 2.0 inches diameter for a cable core diameter of approximately 0.25 to 1.50 inches incorporating 6 to 100 pairs of conductors. In general, the diameter and spacing between rollers increase with larger diameter cores. The diameters and spacing of the rollers are such that the cores receive sufficient manipulation by passage around them to assist in and improve powder filling and distribution and while ensuring that the conductors or cores are not in danger of being damaged.

Figure 5:
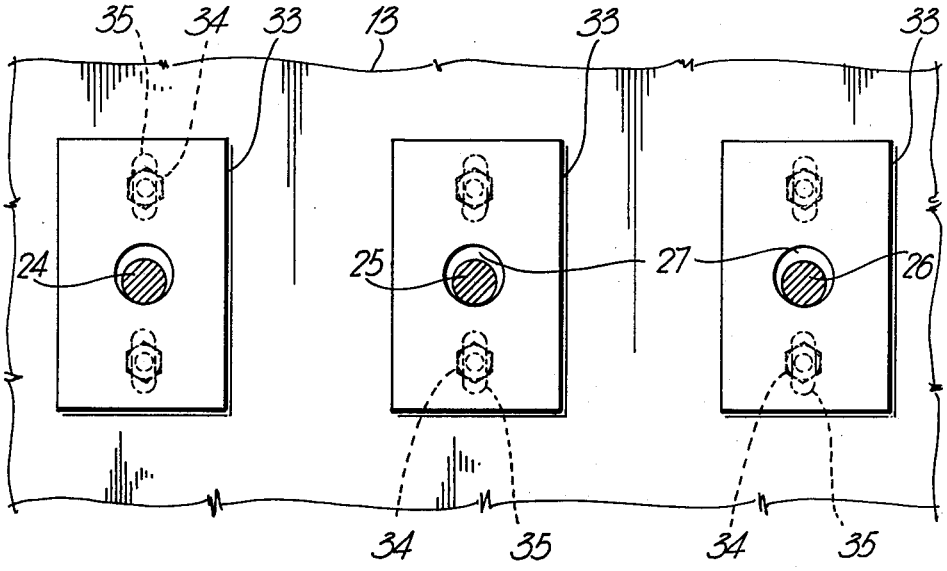
FIG. 5 is a view similar to FIG. 4 of a modification of the first embodiment.

In FIG. 5 is shown a modification of the first embodiment. As shown by FIG. 5, each roller 24, 25, 26 has its own positioning means to enable it to be adjusted separately from the others. For each roller, the positioning means is a bearing plate 33 at each roller end, the bearing plates 33 being mounted by screws 34 received through vertical slots 35 in the sides 13 of the housing to allow for vertical adjustment of the plates.

In a further modification of the first embodiment (not shown), a single core unit replaces the core 31. The core unit is fed through the apparatus with its conductors substantially closed together for the hole of the bed and has its direction of movement changed as in the case of core 31.

In the embodiments to follow, parts of apparatus basically of similar construction to those in the first embodiment will bear the same reference numerals. Also the following embodiments avoid the use of coatings or electrostatic filling methods for reasons given in the first embodiment.

Figure 6:
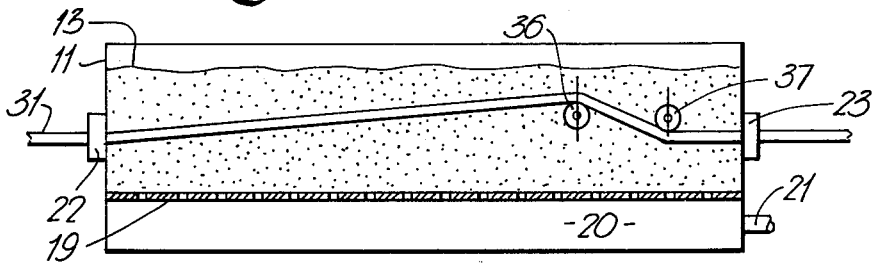
FIGS. 6, 7 and 8 are side views in cross-section of apparatus forming, respectively, second, third and fourth embodiments.

In a second embodiment shown in FIG. 6 which is otherwise the same as the first embodiment, powder filling apparatus comprises two rollers 36 and 37 inside the fluidized bed. The core 31 is fed over roller 36 and under roller 37 so that it has change in direction of movement and flexure in opposite lateral directions to relatively move the conductors and assist in filling the core.

In a third embodiment (FIG. 7) also using two rollers 36, 37, a cable core opener 38 is disposed upstream of the rollers (in the sense of the direction of movement of the core of its feedpath). The opener 38 has a freely rotatable opening member (not shown) and may be of a construction described in U.S. patent application Ser. No. 930,236 filed Aug. 2, 1978, in the name of John Nicholas Garner and with the present assignee.

In use, a cable core 39 is to be powder filled by the apparatus. This core comprises one or more central core units 40 (one being shown in FIG. 7) and a plurality of outer core units 41 (two being shown in FIG. 7). Because it is difficult to powder fill the core with the core units closed together, because of the inaccessability of the central core unit to the powder, the core units need to be separated into spaced positions for the core unit filling procedure. Thus after the closed cable has been fed through the inlet die 22, the core units 40, 41 are separated by the cable core opener 38. Rotation of the opener caused by passage therethrough of the units 40, 41 enables the units to recombine downstream of the opener, in the direction of movement of the core, to reclose the cable core. Reclosing of the cable core naturally occurs as a leading end of the core is formed into a closed condition at the beginning of the operation and the twist on the core units causes them to follow their previous closed paths after passing through the opener.

Figure 7:
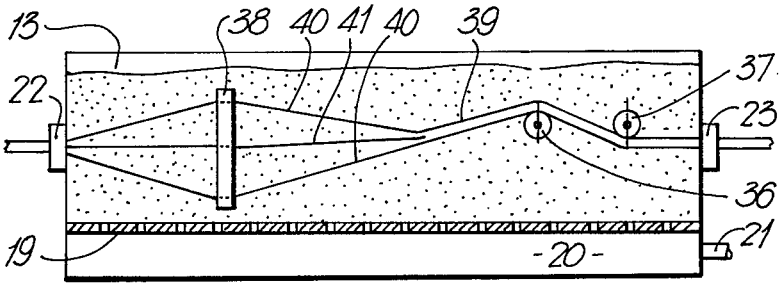

With the core units spaced by the opener as in FIG. 7, the powder in fluid state fills the voids between closed together conductors of each core unit 40 and 41. During closing of the core units together to reform the closed cable core, powder flows into the voids between the units also. The closed core then moves forward towards and around the rollers 36, 37. During the forward movement, fluidized powder continues to infiltrate between the conductors of the outer units and between the units themselves. Passage of the cable core around the rollers 36 and 37 is in a manner similar to that described in the first embodiment to provide more complete and uniform filling.

Figure 8:
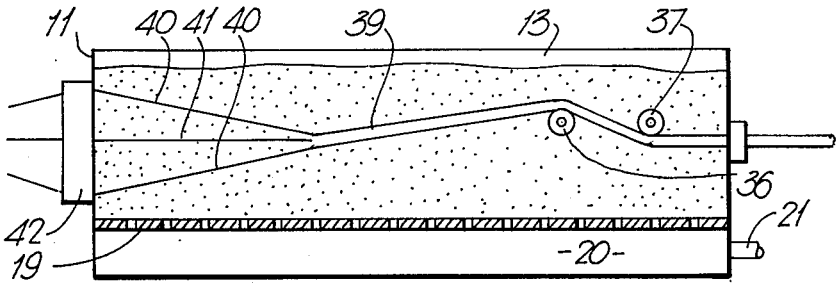

In a fourth embodiment shown in FIG. 8, the apparatus differs from FIG. 7 solely in that the cable opener 42 is mounted upon the inlet end 11 on the outside of the housing. As shown in FIG. 8, the cable core 39 is then already opened with its core units 40 and 41 spaced apart when it enters the fluidized bed 18.

Th location of roller 36 downstream of the opener 38 is such that the core units are substantially closed together in the core, i.e. they are sufficiently closed together that the roller 36 effects relative displacement of the conductors of each core unit.

What is claimed is:

1. A method of powder filling a cable core unit having a plurality of conductors, said method comprising:

fluidizing a bed of filling powder to form a fluidized bed with a defined upper surface;

passing the core unit along a pass line through the fluidized bed and beneath its defined upper surface with the conductors closed together, the fluidized powder in the bed flowing between the conductors to fill voids within the unit while avoiding attracting the powder to the conductors electrostatically or with other attracting medium; and with the conductors closed together and in the fluidized bed, causing the unit to change its direction of movement along the pass line at least once to effect relative displacement of the conductors while maintaining them closed together.

2. A method according to claim 1 wherein the core unit is caused to change its direction of movement by passage of the unit partly around the periphery of a rotatable member.

3. A method according to claim 1 wherein the core unit is caused to change its direction of movement firstly in one lateral direction and secondly in another lateral direction.

4. A method according to claim 3 wherein the core unit is passed in succession partly around the peripheries of two rotatable members disposed in spaced relationship.

5. A method as claimed in claim 1 wherein the core unit is wrapped with a tape upon exit from the fluidized bed.

6. A method of powder filling a cable core comprising a plurality of core units wherein the cable core is passed through the bed, each core unit is powder filled as defined in claim 1 and with the core units substantially closed together in the cable core, all of the core is caused to change its direction of movement along the pass line at least once to effect the relative displacement of the conductors in each core unit.

7. A method according to claim 6 wherein in the cable core, the core units are substantially closed together during the whole passage of the core through the bed.

8. A method according to claim 6 wherein the cable core has a central core unit, and the core units are spaced-apart in the bed to allow powder to fill voids in the central core unit, and the core units are then brought into positions substantially closed together before causing the core to change its direction of movement along the passline.

* * * * *